US008166908B2

(12) United States Patent
Mauchle et al.

(10) Patent No.: US 8,166,908 B2
(45) Date of Patent: May 1, 2012

(54) POWDER SPRAY COATING DEVICE AND POWDER FEEDING DEVICE THEREFOR

(75) Inventors: Felix Mauchle, Abtwil (CH); Mark Steinemann, Hofstetten (CH)

(73) Assignee: ITW Gema GmbH, St. Gallen (CH)

( * ) Notice: Subject to any disclaimer, the term of this patent is extended or adjusted under 35 U.S.C. 154(b) by 986 days.

(21) Appl. No.: 12/158,048

(22) PCT Filed: Dec. 18, 2006

(86) PCT No.: PCT/IB2006/003690

§ 371 (c)(1),
(2), (4) Date: Jun. 19, 2008

(87) PCT Pub. No.: WO2007/072174

PCT Pub. Date: Jun. 28, 2007

(65) Prior Publication Data

US 2008/0257257 A1 Oct. 23, 2008

(30) Foreign Application Priority Data

Dec. 20, 2005 (DE) ..... 10 2005 060 833

(51) Int. Cl.
*B05C 5/02* (2006.01)

(52) U.S. Cl. ..... 118/302; 118/308; 239/106

(58) Field of Classification Search ..... 118/302, 118/308; 427/180; 239/106, 109; 222/335, 222/405, 630; 141/65, 130; 406/114, 141, 406/145, 137

See application file for complete search history.

(56) References Cited

U.S. PATENT DOCUMENTS

| | | | | |
|---|---|---|---|---|
| 4,265,572 | A | 5/1981 | Bourdois et al. | |
| 4,497,598 | A * | 2/1985 | Blanton | 406/114 |
| 6,021,821 | A * | 2/2000 | Wegman | 141/93 |
| 6,454,141 | B1 * | 9/2002 | Breen et al. | 222/405 |
| 6,945,470 | B2 | 9/2005 | Kia et al. | |
| 2001/0050049 | A1 | 12/2001 | Kramer et al. | |
| 2003/0190200 | A1 | 10/2003 | Hajima et al. | |

FOREIGN PATENT DOCUMENTS

| | | |
|---|---|---|
| DE | 29518478 | 1/1996 |
| DE | 19903578 | 8/2000 |
| EP | 0008270 | 2/1980 |
| EP | 1331183 | 7/2003 |
| FR | 2795663 | 1/2001 |
| JP | 63258628 | 10/1988 |
| JP | 2001079506 | 3/2001 |
| JP | 2001259551 | 9/2001 |
| JP | 2004016933 | 1/2004 |

OTHER PUBLICATIONS

ISR for PCT/IB2006/003690 dated Jul. 2, 2007.
DE Search Report for 10 2005 060 833.7 dated Sep. 26, 2006.

* cited by examiner

*Primary Examiner* — Laura Edwards
(74) *Attorney, Agent, or Firm* — Lowe Hauptman Ham & Berner LLP

(57) ABSTRACT

Powder spraycoating equipment and powder supply system for same. The powder supply system comprises a closed or closable powder receptacle which is fitted with a cleaning fixture to remove residual powder from a powder chamber of the powder receptacle using compressed cleaning air.

22 Claims, 6 Drawing Sheets

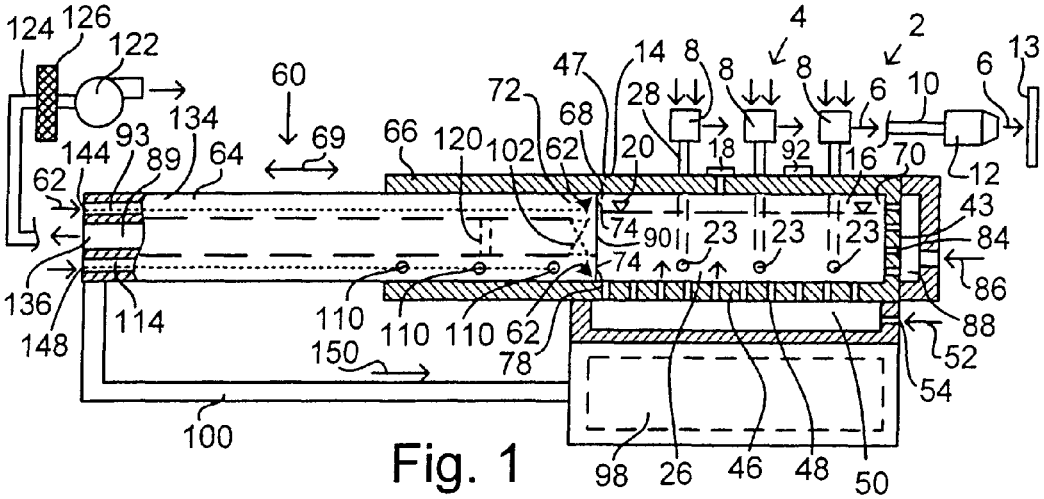
Fig. 1
Fig. 2
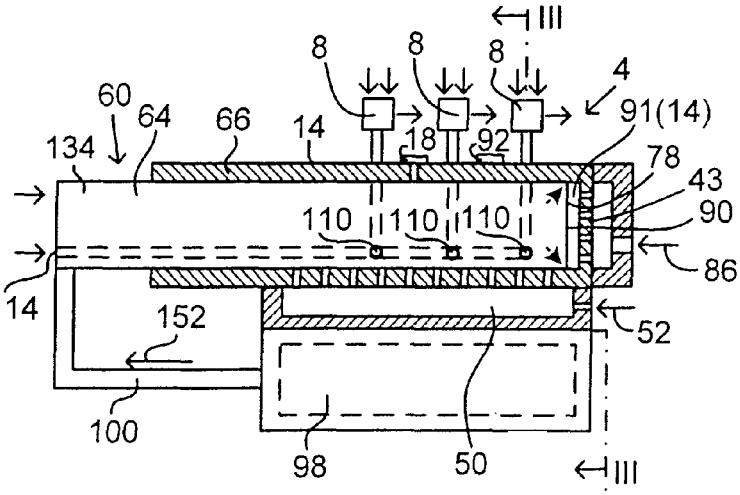
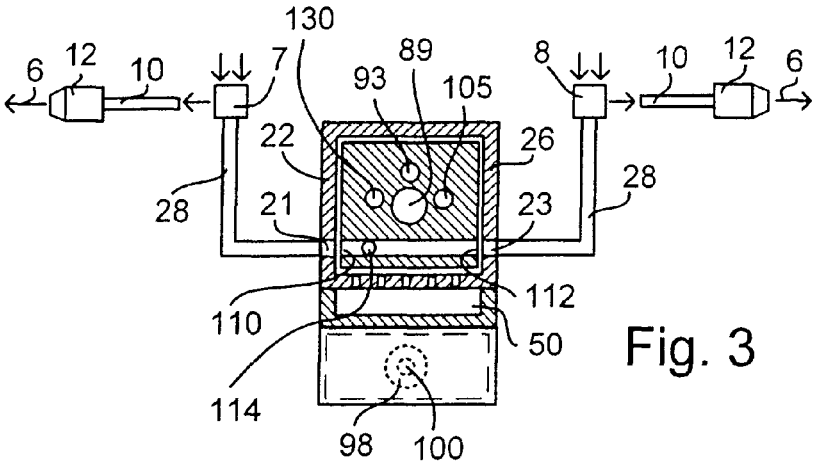
Fig. 3

POWDER SPRAY COATING DEVICE AND POWDER FEEDING DEVICE THEREFOR

RELATED APPLICATIONS

The present application is based on International Application Number PCT/IB2006/003690 filed Dec. 18, 2006, and claims priority from German Application Number 10 2005 060 833.7 filed Dec. 20, 2005, the disclosures of which are hereby incorporated by reference herein in their entirety.

TECHNICAL FIELD

The disclosure relates to a powder supply system.

Moreover the disclosure relates to powder spraying equipment containing the powder supply system.

BACKGROUND

Changing a powder (changing from one kind of powder to another), in particular changing colors (changing from a powder of one color to a powder of another color) requires carefully cleaning the powder spraycoating equipment and the powder supply system(s) because already a few powder particles of the earlier kind of powder may entail coating defects when coating with the new kind of powder.

A powder supply system contains in particular a powder receptacle acting as the powder chamber storing the coating powder. Conventionally the coating powder is fluidized in the powder receptacle in order that it may be easily conveyed pneumatically either to another powder receptacle or to a powder spray equipment. Latter may be operated manually or automatically and be fitted with a spray nozzle or a rotary atomizer.

There is a need to create the ability to change powders in especially expedited manner.

SUMMARY

A powder supply system for powder spraycoating equipment comprises a closed or closable powder receptacle fitted with a powder chamber for coating powder. The powder receptacle comprises a cleaning fixture to automatically remove residual powder from the powder chamber using compressed cleaning air. The cleaning fixture is fitted with at least one mechanically guided plunger which is configured in reciprocable manner along a guided path between one chamber end and an opposite chamber end relative to the said powder chamber. The plunger is fitted at its front end zone with at least one compressed cleaning air outlet which is aimed toward at least one chamber wall near it, whereby compressed cleaning air issuing from the compressed cleaning air outlet shall impact the nearby chamber wall to blow residual powder away from said wall. At least one residual powder outlet to remove compressed cleaning air and powder contained in it from the powder chamber is included.

An embodiment of the present invention comprises a suction device to aspirate residual powder and compressed cleaning air from the powder chamber into the minimum of one residual powder outlet. The suction device may be a suction fan which pneumatically communicates through a residual powder outlet duct and an adjoining conduit to the said residual powder outlet, and/or at least one compressed conveying air intake to introduce compressed conveying air into the residual powder outlet, or into an adjoining residual powder outlet duct.

In another special embodiment mode of the present invention, at least one wall of the powder chamber is fitted with at least one powder feed aperture through which coating powder may be aspirated from the powder chamber. In this embodiment mode the plunger preferably is fitted with at least one compressed flushing air outlet to force compressed cleaning air toward the powder chamber into the minimum of one powder feed aperture and through an adjoining powder feed path when the plunger has reached a given depth of penetration in the powder chamber.

BRIEF DESCRIPTION OF THE DRAWINGS

The embodiments of the present invention are elucidated below by the appended drawings.

FIG. 1 shows, in schematic and partly lengthwise section, powder spraycoating equipment comprising a powder supply system of the invention, a plunger of a cleaning fixture being indicated in a retracted position in which spraycoating can be carried out, FIG. 2 is the powder supply system of FIG. 1, the plunger being shown during a cleaning procedure in an advanced front aiming position in which powder the conveying means and the powder hoses connected to them may be cleaned, FIG. 3 is a schematic cross-sectional elevation of the powder spraycoating equipment of FIG. 2 along the cross-sectional line III-III of FIG. 2.

DETAILED DESCRIPTION

Figure 4:
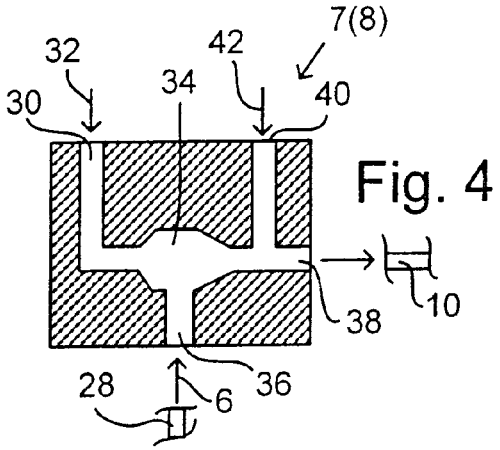
FIG. 4 is a schematic cross-sectional view of an injector of the powder supply system of FIGS. 1 through 3.

The powder spraycoating equipment 2 shown in FIGS. 1 through 3 comprises a powder supply system 4 from which coating powder 6 may be moved by at least one, preferably several injectors 7 and 8 through powder hoses 10 to spray implements 12 and from latter can be sprayed onto an object to be coated 13. Conveying means other than injectors 7 and 8 also my be used for the powder, for instance powder pumps.

The powder supply system 4 comprises a closed or closable powder receptacle 14 constituting a powder chamber 16 to store coating powder and at least one powder intake 18 to move coating powder into the powder chamber 16.

The powder intake 18 may be in the form of an intake aperture to automatically move coating powder into the powder chamber 16 in order to maintain in said chamber, in continuous or discontinuous manner, a predetermined powder level 20 in a range of powder levels. In another embodiment mode the powder intake 18 may be a lid to allow manually filling the powder chamber 16 up to said predetermined level, At least one powder feed aperture 21 or 23 is present in at least one of the chamber walls. As regards the embodiment of FIGS. 1, 2 and 3, there are illustratively six powder feed apertures corresponding to the number of injectors 7 and 8. Of those six said apertures, three powder feed apertures 21 are present in a lateral longitudinal wall 22 of the powder chamber 16 and are in fluid communication with the injectors 7 and three powder feed apertures 23 are present in the opposite lateral longitudinal wall 26 of the powder chamber 16 and are in fluid communication with the injectors 8.

The powder feed apertures 21 and 23 are configured as low as possible in the powder chamber 16 in order to aspirate by means of the injectors 7 and 8 if possible all the coating powder out of the powder chamber 16. The injectors 7 and 8 preferably shall be configured higher than the highest powder level 20 and are each connected through a tube 28 with one of the powder feed apertures 21 or 23. Because the injectors 7 and 8 are situated above the maximum powder level 20, the coating powder cannot rise out of the powder chamber 16 into the injectors 7 and 8 when said injectors are OFF.

FIG. 4 schematically shows the basic design of such an injector 7 and 8. It comprises an intake 30 for compressed conveying air 32 which, in a partial vacuum zone 34, generates a partial vacuum and thereby aspirates coating powder 6 out of the powder chamber 16 at a powder suction intake 36 and then conveys said powder through a powder outlet 38 and a powder hose 10 to a receiving station for instance in the form of the spray system 12 or a further powder receptacle. To enhance powder conveyance, the injector may be fitted with a supplementary compressed air intake 40 to feed additional compressed air 42 into the flow of conveying air and powder at the powder outlet 38.

Preferably the invention comprises a fluidizing system to introduce compressed fluidizing air into the powder chamber 16. The compressed fluidizing air may be guided through an end-face wall 43, through a side wall 22, 26, a base wall 46 or a top wall 47, into the powder chamber 16. In the preferred embodiment mode, the base wall 46 of the powder chamber 16 is designed as the fluidizing base. Said base wall is fitted with a plurality of open pores or small transmission holes 48 allowing compressed fluidizing air to flow, from a fluidizing compressed air chamber 50 situated underneath the base wall 46, upward into the powder chamber 16 in order to impart a floating state (fluidization) to the coating powder therein so it may be easily aspirated by the injectors 7 and 8. The compressed fluidizing air 52 is fed through the compressed fluidizing air intake 54 to the compressed fluidizing air chamber 50.

The powder receptacle 14 is fitted with a cleaning fixture 60 to remove residual powder from the powder chamber using compressed cleaning air 62. The cleaning fixture 60 comprises at least one mechanically guided plunger 64 which is linearly reciprocable between a rear chamber end 68 and an opposite front chamber end 70 within the powder chamber 16 as indicated by a corresponding arrow 69. At its front end zone 72, the plunger 64 is fitted with at least one compressed cleaning air outlet 74 pointing at its adjacent chamber walls 22, 26, 46, 47, whereby compressed cleaning air 62 issuing from the compressed cleaning air outlet 74 impinges the nearby chamber walls from which it removes their residual powder. The minimum of one compressed cleaning air outlet (s) 74 contains(s) preferably a large number of compressed cleaning air outlet apertures which issue along the external periphery of the front end zone 72 at said periphery and/or issue near it at said zone's forward pointing end face 78. The compressed cleaning air outlet apertures of the compressed cleaning air outlet 74 issuing from the external periphery of the front end zone 72 of the plunger 64 are configured in a manner that the compressed cleaning air shall be aimed at the chamber walls and then shall flow along said walls forward into the powder chamber 16.

As shown in FIG. 3, the cross-section of the powder chamber 16 may be rectangular or polygonal or circular.

At its front end opposite the plunger 64, the powder chamber 16 is bounded by the front end-face wall 43. This front, end-face wall 43 may be hermetic against air or it may be porous and air-permeable or it may be fitted with a plurality of ports 84. Compressed air in the form of compressed cleaning air or compressed fluidizing air may be guided through the ports 84 into the powder chamber 16. In a separate embodiment mode, the pressure of said compressed air may be varied so that, depending on operational or cleaning conditions, said compressed air shall be in the form of compressed fluidizing air used in spraycoating or compressed cleaning air used to clean the powder chamber 16. Illustratively this compressed air 86 may be fed into a manifold chamber 88 configured outside the powder chamber 16 beyond the end-face wall 43 in a zone also containing the ports 84.

Moreover the invention includes a residual powder outlet 90 at the front end of the residual powder outlet duct 89 to evacuate compressed cleaning air 62 and the residual powder in it from the powder chamber 16. The residual powder outlet 90 may be configured in a wall of the powder chamber 16 or in a gap between the plunger 64 and a peripheral wall of the powder receptacle 14. Preferably the residual powder outlet 90 shall be constituted, as shown in the drawings, in the plunger 64 and preferably therein at the cross-sectional center of said plunger.

The plunger 64 is reciprocable in the linear direction of motion 69 as indicated by the double arrow between the start position shown in FIG. 1, wherein it subtends a rear end-face wall at the rear end of the powder chamber 16, and the front aiming position shown in FIG. 2. In the aiming position shown in FIG. 2, the front end-face 78 of the plunger 64 may rest against the front end-face wall 43 of the powder chamber 16 or it may be separated from said wall by a narrow gap 91.

At least at its front end zone 72, the plunger 64 subtends an external periphery matching the inside periphery of the powder chamber 16. In this respect the end zone 72 may run on all sides as far as the inside periphery of the powder chamber 16 as illustratively shown in FIGS. 1 and 2, or it may approach it close enough that a slight peripheral gap remains between the plunger's outer periphery and the powder chamber's inside periphery. Preferably compressed cleaning air 62 is moved into the peripheral gap toward the powder chamber 16 and thereby precludes coating powder in the powder chamber from entering said gap. When the plunger 64 is in its start or initial position shown in FIG. 1, the injectors 7 and 8 are able to move coating powder out of the powder chamber 16 to the spray implements 12. Moreover coating powder may be introduced either manually or preferably automatically through the powder intake 18 into the powder chamber 16.

Preferably a level sensor 92 detecting the powder level in the powder chamber 16 is included in the design of the invention. Preferably the level sensor 92 is a proximity sensing device and is configured outside and apart from the powder chamber 16. In this manner the level sensor shall not be fouled. The level sensor 92 generates a signal when the powder level has reached a given height. Several such powder level sensors 92 also may be configured at different heights for instance to detect a predetermined maximum and a predetermined minimum level. The signals from the minimum of one level sensor(s) are preferably used to control the automated feed of coating powder through the powder intake 18 into the powder chamber 16 in order to maintain a predetermined level, or a predetermined range of levels, during a time interval when the injectors 7 and 8 aspirate coating powder from the powder chamber 16 and pneumatically convey it to the spray implements 12 (or into another receptacle).

Compressed cleaning air is guided not at all or only at reduced pressure into the powder chamber 16 during such powder spraycoating operations.

To clean the powder chamber 16 during such pauses between coating, for instance when changing from one kind powder to another, compressed cleaning air 62 is guided through a compressed cleaning air duct 93 in the plunger 64 to the minimum of one compressed cleaning air outlet 74 and from latter into the powder chamber 16 in order to blow residual powder off said chambers walls 22, 26, 46, 47, 43. To enable the compressed cleaning air to clean the entire zone of the powder chamber 16, the plunger 64 shall be moved at least once from the start position shown in FIG. 1 through the powder chamber 16 into the aiming position shown in FIG. 2 and then fully back. In this procedure the compressed cleaning air 62 flows toward the nearby chamber walls of the powder chamber 16 where it where it blows off the residual powder and then flows into the residual powder outlet 90 as shown schematically by arrows 94 in FIG. 4.

At least one residual powder outlet 90 of the preferred embodiment mode is configured in the front end-face 78 of the plunger 64 at the cross-sectional center, the port(s) of the compressed cleaning air outlet 74 being situated transversely to the cross-sectional center outside the residual powder outlet 90.

The powder chamber 16 contains no integrated parts that might hamper the motion of the plunger 64.

A guide 66, which constrains a linear, i.e. a straight reciprocating motion 69 of the plunger 64, may be in the form of an extension of the powder receptacle 14 or may be affixed to said receptacle. Obviously the plunger 64 is closed by seals and/or by compressed air relative to the powder chamber 16 in a manner that no coating powder may escape from the powder chamber 16 between the plunger 64 and the peripheral walls near it.

Preferably the plunger shall not be driven manually but instead by a drive 98 (a source of drive power), preferably by a linear drive which is mechanically linked with the powder receptacle 14 to form a powder coating system unit and is connected by a displaceable drive element 100 to the plunger 64. The power of the drive 98 may be electrical, or pneumatic, or hydraulic.

Figure 5:
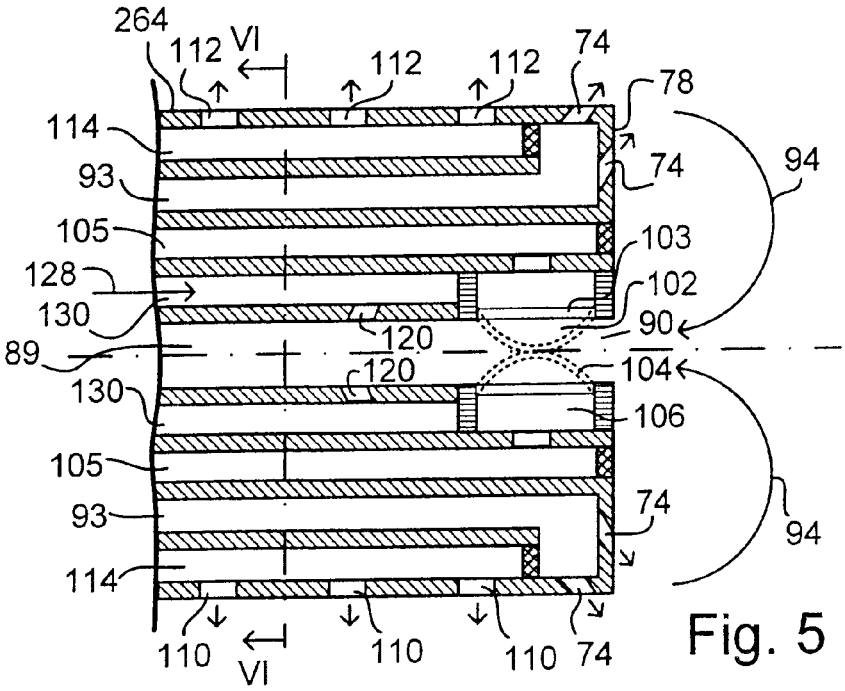
FIG. 5 is a segment of a longitudinal section of the front end zone of a further embodiment mode of the plunger of FIGS. 1 through 3.

A control valve 102 to alternatively close and open the residual powder outlet 90 is configured at said outlet or in its immediate vicinity. As schematically shown in dashed lines 104 in FIG. 5, the valve 102 is closed, whereby the front side constitutes a powder-tight end-face wall 78 of the powder chamber 16 together with the end-face side 78 of the plunger 64. When this plunger is in its start position and cleaning does not take place. The start position of the plunger 64 is shown in FIG. 1. The valve 102 is open to evacuate the mixture consisting of compressed cleaning air and the residual powder it entrains, as shown in FIG. 5 by the solid lines 103, when cleaning the powder chamber 16 takes place, the plunger 64 being reciprocated at least once between the start position of FIG. 1 and the aiming position of FIG. 2. Preferably the valve 102 is a squeeze valve as schematically indicated in FIG. 5. By applying compressed control air through a compressed control air duct 105, said squeeze valve may be closed in its compressed valve chamber 106 and by reducing or shutting off the pressure of compressed control air it may be opened.

As regards a special design of the invention, the plunger 64 is fitted with at least one compressed flushing air outlet port which each time shall be opposite one of the minimum of one powder feed aperture(s) 21 or 23 and being directed toward the latter only when the plunger 64 at least partly penetrates the powder chamber 14 and assumes a predetermined position of penetration. Preferably there are as many compressed flushing air outlet apertures as there are powder feed apertures, the said compressed flushing air outlet apertures being configured at the plunger 64 behind the front end zone 72 in a manner that they all are outside the powder chamber 16 when the plunger 64 assumes in its start position shown in FIG. 1, whereas the compressed flushing air outlet apertures together with the plunger 64 being moved into the powder chamber 16 when the plunger 64 assumes is predetermined position of penetration which preferably shall be the aiming position.

FIGS. 1 through 3 show an illustrative embodiment of this kind. For instance three (or fewer, or more) compressed flushing air outlet apertures 110 are configured in the plunger 64 behind the front end zone 72 on one of the longitudinal plunger sides and the same number (or fewer or another number) of compressed flushing air outlet apertures 112 are configured on the other longitudinal plunger side. Said compressed flushing air outlet apertures 110 and 112 are arrayed in such manner in the plunger 64 outside the powder chamber 64 that, in the start position of FIG. 1 of said plunger 64, they are situated outside the powder chamber 16, in this instance being opposite each to one of the powder feed apertures 21 or 23 and pointing at the latter when the plunger 64 enters said powder chamber 16 as far as a given depth of penetration which in this case is the aiming position of the plunger 64 shown in FIG. 2. The powder feed apertures 21 and 23 being constituted in the longitudinal side walls 22 and 26 of the powder chamber 16, the compressed flushing air outlet apertures 110 and 112 are constituted in the opposite longitudinal sides of the plunger 64. As a result and as regards the aiming position of the plunger 64 shown in FIG. 2, compressed flushing air may be guided through a compressed flushing air duct 114 of the plunger 64, so that it flows out of the compressed flushing air outlet apertures 110 and 112 into the powder feed apertures 21 and 23 and from there through the tubes 28, then through the injectors 7 and 8 and next through the powder hoses 10 and through the spray implement in order to blow residual powder out of it. Thereupon the plunger 64 may be moved back from the aiming position shown in FIG. 2 into the start position shown in FIG. 1. Then the powder chamber 16 again can be filled through the powder intake 18 until the predetermined level 20 has been reached. Next a new coating procedure can be initiated, wherein coating powder is pneumatically aspirated by the injectors 7 and 8 from the powder chamber 16 and moved to the spray implements 12 to spray the coating powder 6 on the object to be coated 13.

In the shown, preferred embodiment mode of FIGS. 1 and 2, the powder feed apertures 21 and 23 are always configured one behind the other and apart in a row and the compressed flushing air outlet apertures 110 and 112 always are also configured in a row at the same spacing as the powder feed outlet apertures 21 and 23, said rows being configured parallel to each other and parallel to the direction of motion 69 of the plunger 64.

Obviously in other embodiment modes the powder feed apertures 21 and 23 and the compressed flushing air outlet apertures 110 and 112 also may be configured transversely to the direction of motion 69 of the plunger 64 and being mutually spaced apart.

It follows from the exposition above that the powder feed apertures and the compressed flushing air outlet apertures may be configured not only in one or several longitudinal side walls, but additionally or instead also in an upper ceiling wall and/or in a lower base wall.

In another preferred embodiment of the invention, at least one suction device is used to aspirate the mixture of compressed cleaning air 62 and the residual powder it contains out of the powder chamber 16 though the residual powder outlet 90. The minimum of one suction device preferably is fitted with a compressed airjet pump means 120 (for instance an injector or an ejector) configured for instance in the residual powder outlet duct 89 near the residual powder outlet 90 and/or with a suction fan 122 which can be hooked up by means of a hose conduit 124 to the rear end of the residual powder outlet duct. A powder separator 126, for instance a filter, may precede the suction fan 122. The compressed airjet pump means 120 may be fed with compressed conveying air 128 through a compressed conveying air duct 130 constituted in the plunger 64.

The compressed airjet pump means 120 may be fitted with an annular jet noble or a plurality of annularly configured nozzle apertures. It is shown merely schematically in FIG. 1 and in FIG. 5 in the form of a plurality of annularly arrayed injector apertures. The compressed airjet pump means 120 is mounted preferably in the residual powder outlet duct 89 downstream of and near the controlled valve 102.

Figure 6:
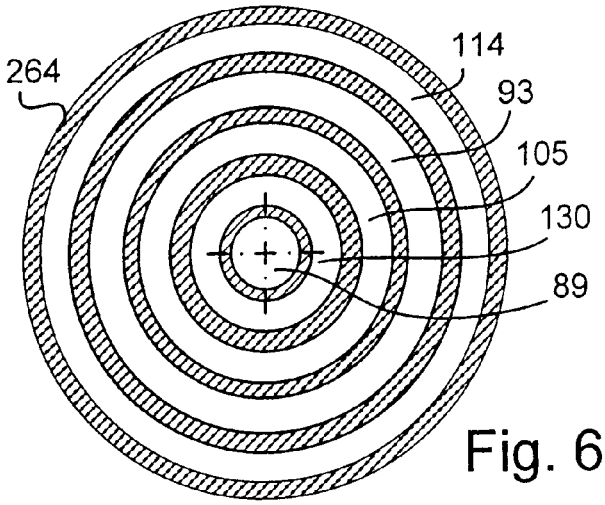
FIG. 6 shows a cross-section of the plunger of FIG. 5 along the cross-sectional line VI-VI, FIG. 7 schematically shows a side view partly in vertical section, of a further embodiment mode of a powder supply system of the invention when out of operation.

The powder chamber 16 and the plunger 64 exhibit a rectangular cross-section in the embodiment mode shown in FIGS. 1, 2 and 3, whereas their cross-section is circular in the embodiment of FIGS. 5 and 6. Otherwise both embodiment modes may be denoted by the same reference numerals. The duct cross-sections may be open as shown in the embodiments of FIGS. 1, 2 and 3 or be like concentric frames, for instance concentric circles according to FIGS. 5 and 6, or a combination thereof. The residual powder outlet duct 89 and the residual powder outlet 90 preferably exhibit a circular, open cross-section. All the features discussed above regarding the plunger 64 of FIGS. 1 through 3 are present also in the plunger 264 of FIGS. 5 and 6. The plunger 264 enters an omitted powder chamber fitted with a circular cross-section matching the plunger 264; otherwise said plunger exhibits all the features of the powder chamber 16 in the receptacle 14 of FIGS. 1 through 3.

In the embodiments shown in FIGS. 1 through 5, the controlled valve 102 is configured directly at the residual powder outlet 90 and the compressed airjet pump means 120 is mounted downstream of and near said valve 102.

All intakes and outlets disclosed within the scope of the invention may each comprise one or more apertures, illustratively consisting of a plurality of apertures or of one or more slot apertures, for instance one or more annular slot nozzles or frame-like polygonal slot nozzles.

Figure 15:
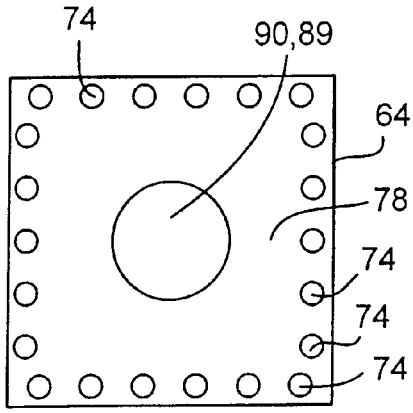
FIG. 15 is front end-face view of the plunger of FIGS. 1 through 3.
Figure 16:
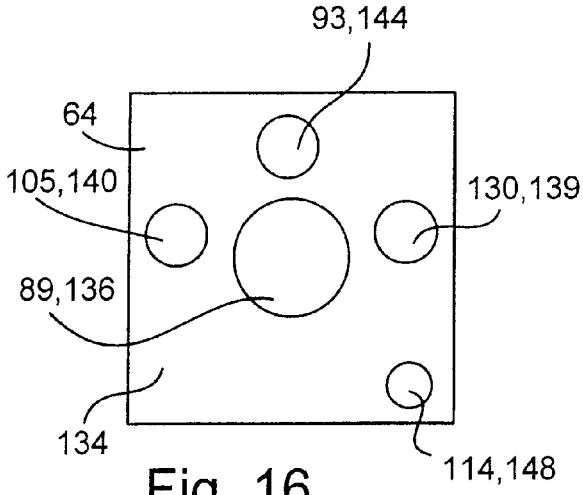
FIG. 16 is a rear, end-face view of the plunger of FIGS. 1 through 3, and FIG. 17 schematically shows a further embodiment mode of the invention.

The plunger 64 or 264 comprises a rear end zone 134 mounted outside the powder chamber 16 even when the plunger 64 or 264 has fully penetrated by its front end zone 72 the powder chamber 16. A plurality of ducts run longitudinally through the plunger 64 from the front end zone 72 to the rear end zone 134, preferably parallel to its direction of motion 69, in particular the residual powder outlet duct 89 runs from the residual powder outlet 90 at the front end zone 72 to a hookup aperture 136 at the rear end zone 134; the compressed air conveyance duct 130 runs from the minimum of one aperture of the compressed aid jet pump means 120 (injector) to a hookup aperture 139 at the rear end zone 134; the control compressed air duct 105 runs from the valve pressure chamber 106 of the controlled valve 102 to a hookup aperture 140 at the rear end zone 134; the compressed cleaning air duct 93 runs from the compressed cleaning air outlets 74 to a hookup aperture 144 at the rear end zone 134; the compressed flushing air duct 114 runs from compressed flushing air outlet apertures 110 and 112 to a hookup aperture 148 at the rear end zone 134. FIG. 15 shows another front end view and FIG. 16 shows a rear end view of the plunger 64.

The drive 98 moves the plunger 64 or 264 in the direction of an arrow 150 from the start position shown in FIG. 1 to the aiming position shown in FIG. 2 and then back as indicated by an arrow 152.

In the preferred embodiment modes of the invention, the plunger 64 or 264 may penetrate horizontally the powder chamber 16 and back out of it again. In other embodiment modes however, the powder receptacle 14 and the cleaning fixture 60 also may be designed in a manner that the plunger 64 or 264 is able to penetrate the powder chamber 16 vertically or obliquely from above to below and then be retractable upward. The expression "plunger" regarding the component 64 or 264 merely is meant to convey that it is able to reciprocably enter the powder chamber 16 and then be retracted from it similarly to a piston inside a cylinder. The powder receptacle 14 and the portion of the plunger 64 or 264 entering it each may be cross-sectionally circular or polygonal or oval or other.

Figure 7:
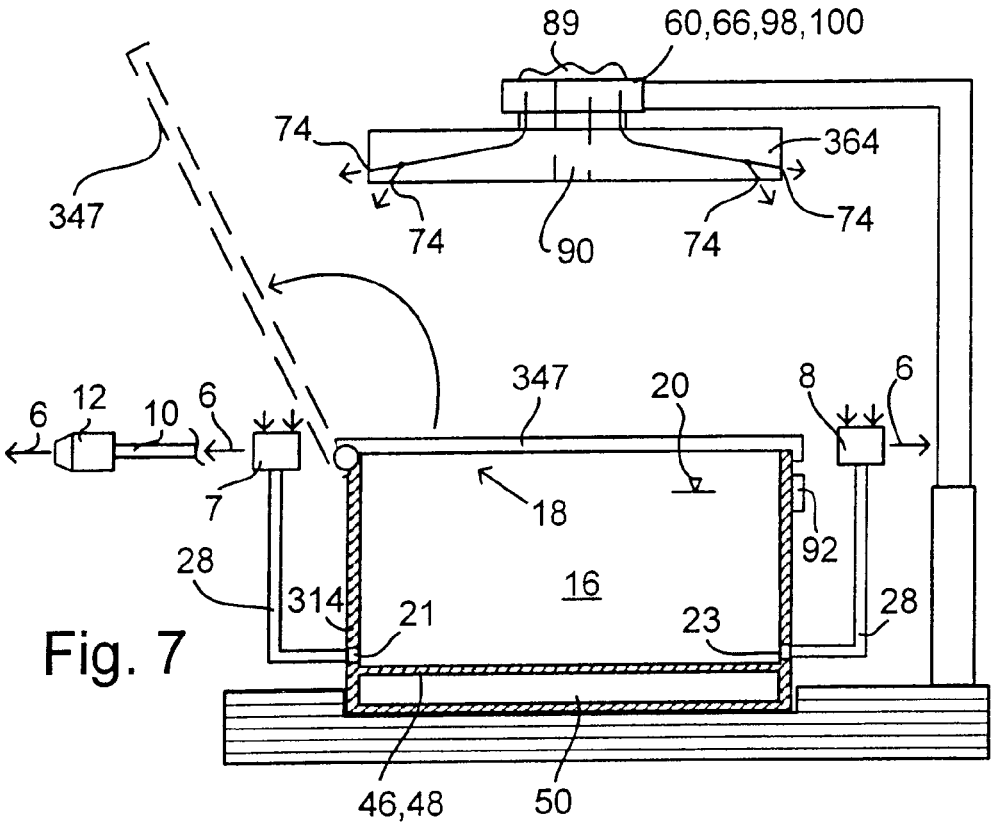
Figure 8:
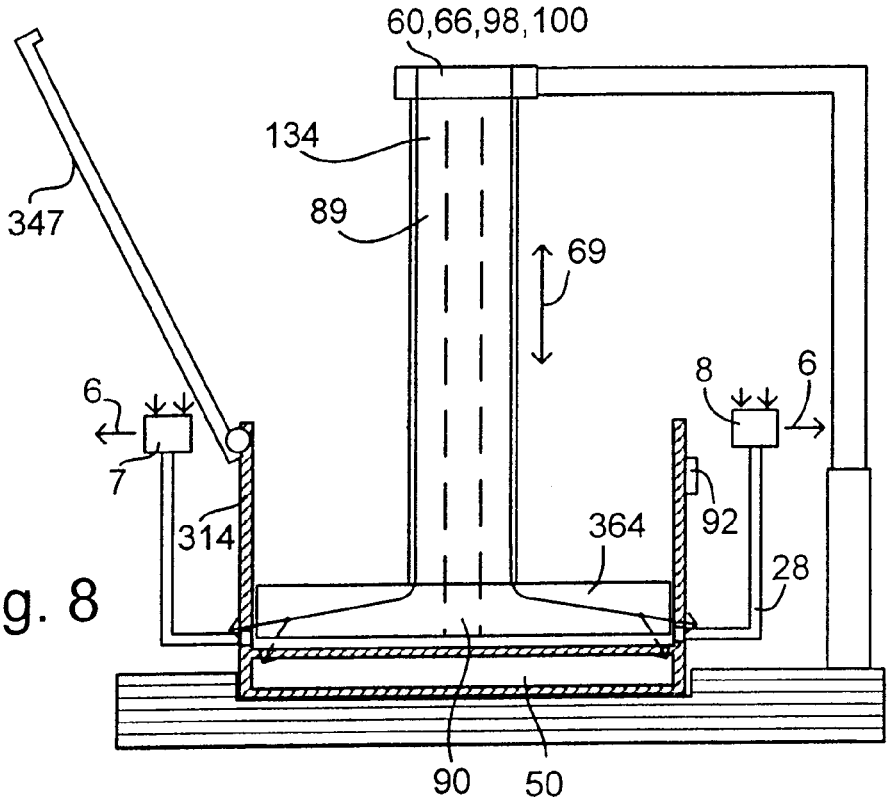
FIG. 8 shows the powder supply system of FIG. 7 during a cleaning procedure.

Another embodiment mode of the invention is shown in FIGS. 7 and 8. Therein a plunger 364 may penetrate from above a powder receptacle 314. The plunger 364 may assume a start position at the top end of the powder receptacle 314 or it may be retractable as a whole out of said receptacle as shown in FIG. 7. When the entire plunger 364 can be retracted out of the powder receptacle 314, the invention preferably provides a lid 347 to seal off the upper end of said receptacle when the plunger 364 is moved back upward out of the powder receptacle 314 into its start position. FIG. 8 shows the plunger 364 in its aiming position. The plunger 364 may be designed just as the plunger 64 of FIGS. 1 through 6. The powder receptacle 314 may designed like the powder receptacle 14 of FIGS. 1 through 3. Further components corresponding to FIGS. 1 through 5 are denoted in FIGS. 7 and 8 with the same reference numerals.

Figure 9:
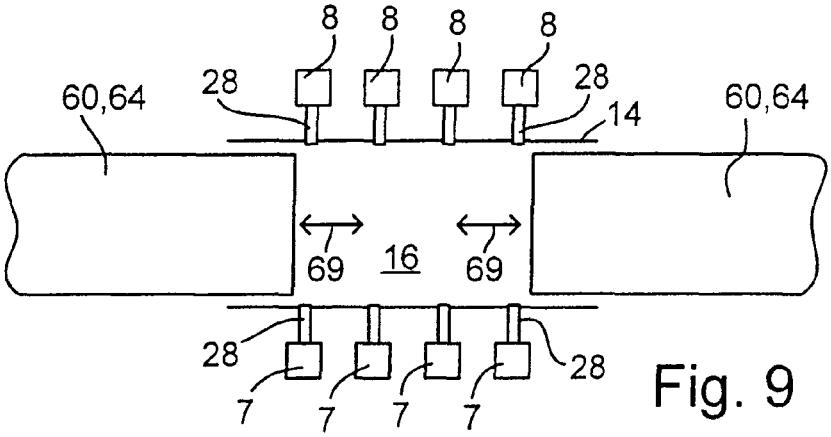
FIG. 9 is a schematic longitudinal section of a further embodiment mode of the invention comprising two plungers in their start positions.
Figure 10:
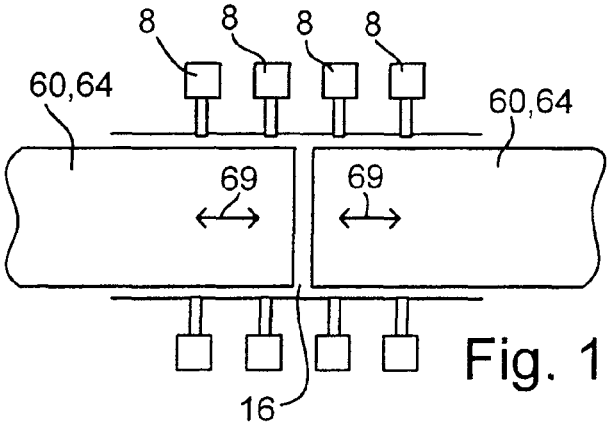
FIG. 10 is a schematic longitudinal section of the powder supply system of FIG. 9, the two plungers being in their advanced aiming position during a cleaning procedure.

FIGS. 9 and 10 schematically show another embodiment mode of the invention. Therein two identical plungers 64 are configured in mutually opposite directions and are each reciprocable along corresponding double arrows 69.

Parts in FIGS. 9 and 10 corresponding to those of FIGS. 1, 2 and 3 are denoted by identical reference numerals. FIG. 9 shows the start position and FIG. 10 shows the aiming position of each plunger 64, which in the aiming position may be a slight distance apart or resting against one another.

Figure 11:
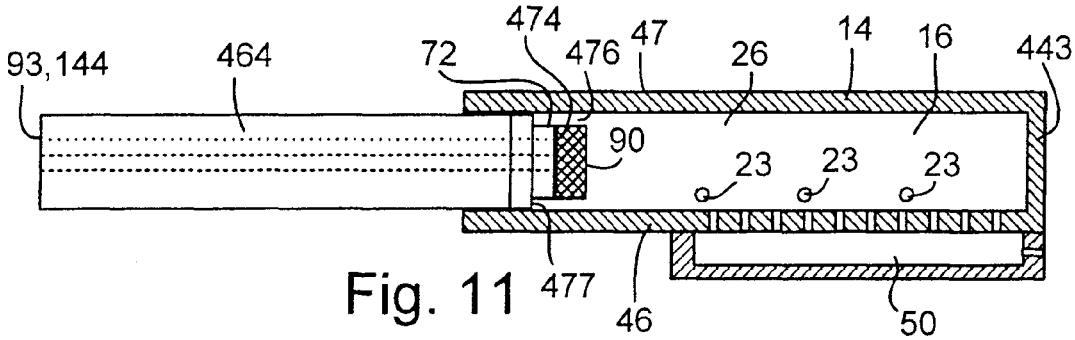
FIG. 11 is a schematic longitudinal section of a further embodiment mode of a powder supply system of the invention, a plunger being shown in its retracted position in which powder spraycoating is possible.
Figure 12:
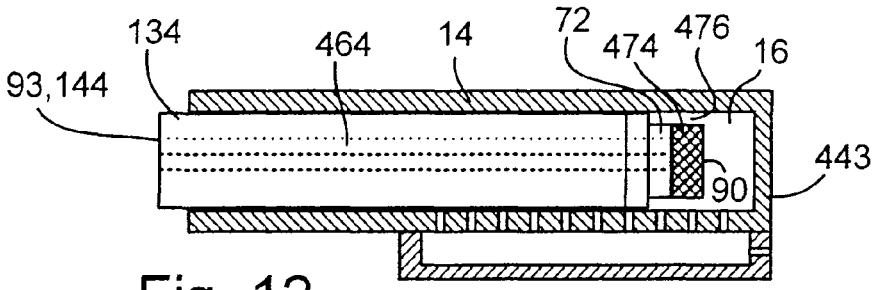
FIG. 12 is a schematic longitudinal section of the powder supply system of FIG. 10, the plunger being shown in an advanced aiming position during a cleaning procedure.

FIGS. 11 and 12 correspond to the embodiment modes of FIGS. 1, 2, and 3 except that a peripheral wall is used as the compressed cleaning air outlet 474 and comprises a very large number of ports or open pores acting as the compressed cleaning air outlet apertures which are fed when needed with compressed cleaning air through the compressed cleaning air duct 93. The peripheral wall constituting the compressed cleaning air outlet 474 is a distance away from its enclosing chamber walls 22, 26, 46, 47 so as to subtend a peripheral gap 476 allowing compressed cleaning air penetration from the compressed cleaning air outlet 474, said entering air then being able to flow forward into the powder chamber 16. The front end zone 72—which is fitted with the compressed cleaning air outlet 474—exhibits a lesser cross-section than the middle portion of the plunger 464 adjoining said front zone at its rear. Otherwise the plunger 464 of FIGS. 11 and 12 is the same as the plunger 64 of FIGS. 1, 2 and 3. The front chamber end-face wall 443 may be fitted with compressed air apertures corresponding to the end-face wall 43 of FIGS. 1, 2 or, corresponding to FIGS. 11 and 12, it may be hermetic.

Figure 13:
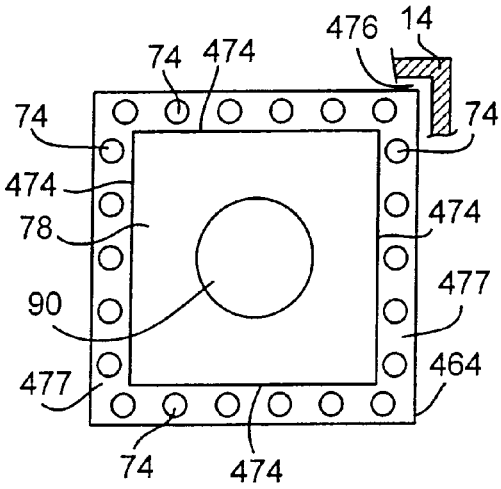
FIG. 13 is a front, end-face view of a plunger of FIGS. 11 and 12.
Figure 14:
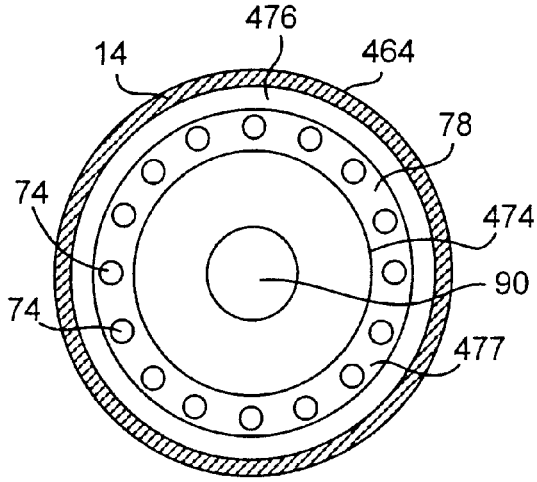
FIG. 14 is a front, end-face view of a further design variation of the plunger of FIGS. 11 and 12.

FIG. 13 is a front elevation of a cross-sectionally rectangular/square embodiment variation and FIG. 14 shows a front elevation of a cross-sectionally circular variation of the plunger 464 and of the housing 14 of the embodiment mode of FIGS. 11 and 12. FIGS. 13 and 14 also indicate the possibility of configuring compressed cleaning air outlets 74 in a forward-pointing offset surface 477 of the plunger 464.

In all embodiment modes, the powder receptacle and the cleaning fixture preferably are mechanically connected to each other to form one unit.

In the manner described above, all embodiment modes allow blowing compressed cleaning air 62 against the walls of the powder chamber 16 to blast residual powder off the chamber walls and then to move this compressed cleaning air and the residual powder through the residual powder outlet 90 out of the powder chamber 16. When the residual powder outlet 90 is closed by the valve 102, the compressed cleaning air 62 together with residual powder may be driven through the powder feed apertures 21 and 23 and from there through the tubes 28 and the injectors 7 and 8, through the spray implements 12. Moreover the invention allows blowing compressed air in the reverse direction through the powder chamber 16 to rid it of residual powder. The last-cited feasibility is applicable to all embodiment modes of the invention and is discussed below in relation to FIG. 17.

Figure 17:
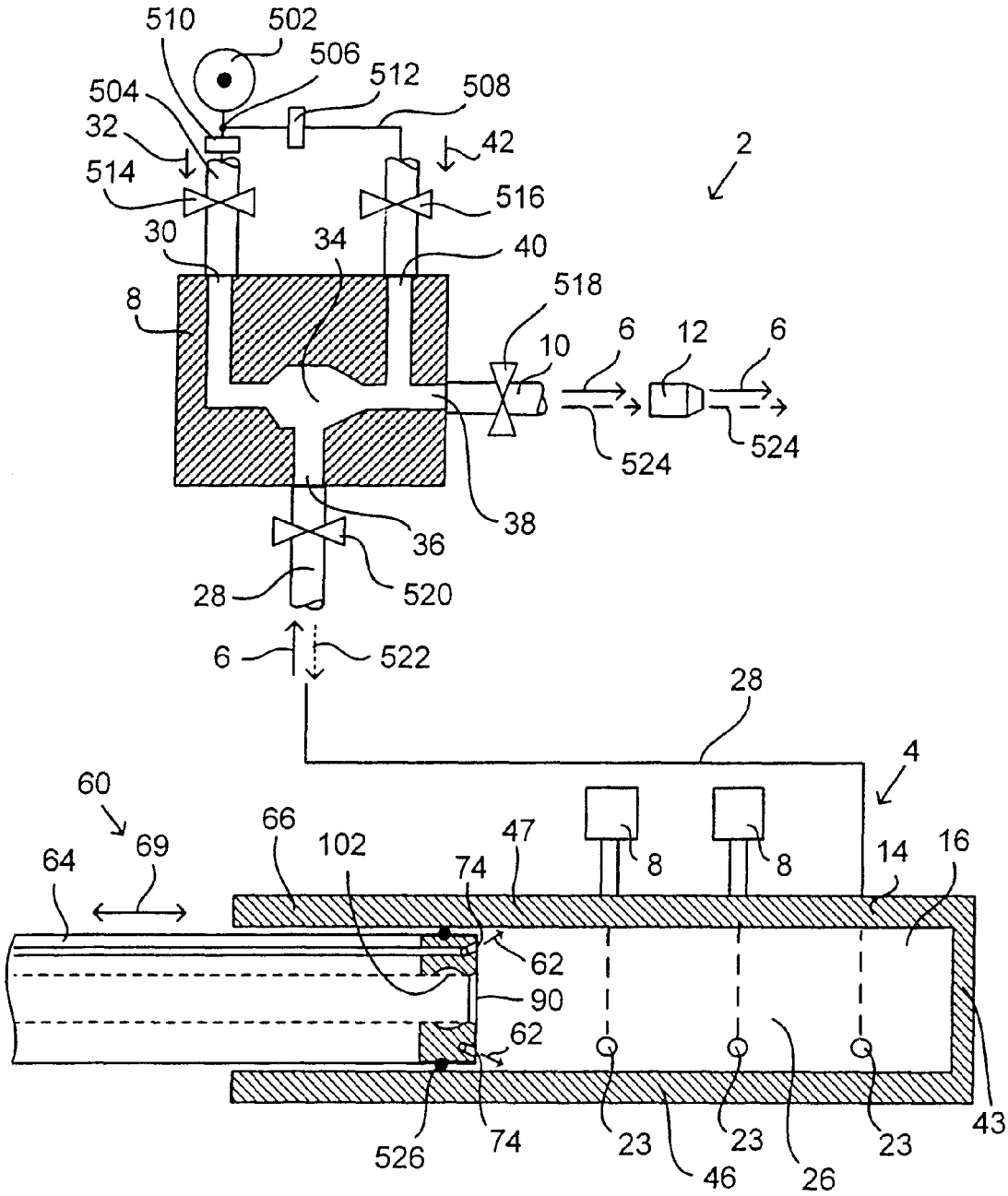

The embodiment mode of a powder spraycoating equipment 2 comprising a powder supply system 4 of the invention is shown in FIG. 17 illustratively is identical with the embodiment of FIGS. 1 through 4, however in FIG. 17 only particular components of FIGS. 1 through 3 are shown and an injector 8 is enlarged, i.e. no longer to scale, and the powder chamber 16 is made smaller, i.e. no longer to scale. Besides the above described embodiment modes of the invention, FIG. 17 does show a source of compressed air 502 of which the pressure side is connected by a compressed conveyance air conduit 504 to a compressed conveyance air intake 30 and is further connected by a branch 506 through an additional compressed air conduit 508 to the additional compressed air intake 40. A pressure adjusting means such as a pressure regulator 510 or 512 may be present in each conduit 504 and 508. A valve 514 is configured in the compressed conveyance air conduit 504; the additional compressed air conduit 508 contains an additional compressed air valve 516; the powder outlet 38 contains a powder outlet valve 518; and the powder suction intake 36 contains a powder intake valve 520. These features make possible several different methods of compressed air cleaning.

In a first method, the compressed conveyance air valve 514 and the additional compressed air valve 516 are closed, whereas the powder intake valve 520 and the powder outlet valve 518 are closed. If the valve 102 of the residual powder outlet 90 also is closed, then the compressed cleaning air 62 jointly with the residual powder are able to flow through the powder feed apertures 21, 23, through the tubes 28, the injectors 7 and 8, the powder hoses 10 and the spray implements 12 and in the process will evacuate residual powder from the powder chamber 16.

A second method of the invention may be carried out in that the powder outlet valve 518 is closed, the powder intake valve 520 is opened, and at least one of the two valves, namely the compressed conveyance air valve 514 and/or the additional compressed air valve 514 is opened and thereby compressed air from the compressed air source 502 is guided through the injectors 7 and 8 and then through the tubes 28 into the powder chamber 16 in order to expel from it residual powder through the residual powder outlet 90, the valve 102 being open (or through another residual powder outlet aperture).

Obviously too, two or more of the above described methods of the invention may be consecutively carried out several times to attain thorough cleaning of the powder chamber 16 and of the powder paths connected to it.

The direction of flow of compressed air from the compressed air source 502 into the powder chamber 16 is shown in FIG. 17 by a dashed arrow 522. The mixture of compressed cleaning air 62 and the residual powder contained in it moving through the powder outlet 38 of the injectors 7 and 8 and through the powder hoses and then through the powder spray implements 12 is schematically indicated in FIG. 17 by a dashed arrow 524.

In another, omitted embodiment mode of the invention, the residual powder outlet 90 may be configured in one of the walls 43, 46 and/or 47 of the powder chamber 16 instead of in the plunger 64.

The powder chamber 16 may be fitted with a de-aeration or an aeration device. Preferably a seal 526 is configured between the plunger 64 (264; 364; 464).

Introduction of the compressed air through the powder feed apertures 21 and 23 into the powder chamber 16 in order to blow the residual powder out of said chamber obviously can also be implemented in other ways than through the injectors 7 and 8, namely also when instead different powder conveying means are used, for instance powder pumps. In the latter case the valves 518 and 520 as well as one of the valves 514 or 516 again may be used to guide compressed air from a compressed air source 502 through the powder conveyance means and then through the tubes 28 to the powder feed apertures 21 and 23 and through the latter into the powder chamber 16.

The invention allows cleaning the powder chambers in automated manner, in particular the inside spaces of powder receptacles. Accordingly the invention also applies to methods automatically cleaning powder chambers, in particular powder receptacles of arbitrary sizes.

The disclosure of the German priority application No. 10 2005 060 833.7 filed 20 Dec. 2006 is incorporated by reference herein in its entirety.

The invention claimed is:

1. A powder supply system for powder spraycoating equipment comprising:

a closed or closable powder receptacle fitted with a powder chamber for coating powder, wherein the powder receptacle comprises a cleaning fixture to automatically remove residual powder from the powder chamber using compressed cleaning air;

at least one mechanically guided plunger configured to move in a reciprocable manner along a guided path between one chamber end and an opposite chamber end relative to the powder chamber;

the plunger includes a front end-face with at least one compressed cleaning air outlet configured to aim toward at least one chamber wall for causing compressed cleaning air issuing from the compressed cleaning air outlet to impact the chamber wall to blow residual powder away from said chamber wall; and at least one residual powder outlet disposed at the opposite chamber end and configured to remove compressed cleaning air and powder contained in said compressed cleaning air from the powder chamber.

2. The powder supply system as claimed in claim 1, wherein the powder chamber comprises at least one powder feed aperture.

3. The powder supply system as claimed in claim 1, wherein said at least one compressed cleaning air outlet is configured to issue compressed cleaning air at a front end-face side of the plunger.

4. The powder supply system as claimed in claim 1, wherein said at least one compressed cleaning air outlet is configured to issue compressed cleaning air from an outward-pointing external peripheral zone of the plunger, wherein the peripheral zone extends transversely to the guided path.

5. The powder supply system as claimed in claim 1, wherein the plunger exhibits an outer periphery, at least at a plunger portion entering the powder chamber, matched to an inner periphery of said powder chamber and the outer periphery extending as far as the inner periphery on all sides.

6. The powder supply system as claimed in claim 1, wherein the at least one residual powder outlet is disposed in the front end-face at cross-sectional center of the plunger, the at least one compressed cleaning air outlet being configured transversely to the cross-sectional center farther outward than the at least one residual powder outlet.

7. The powder supply system as claimed in claim 1, further comprising at least one level sensor for detecting a powder level in the powder chamber.

8. The powder supply system as claimed in claim 1, further comprising a controlled valve in the at least one residual powder outlet to alternatively close and open said outlet.

9. The powder supply system as claimed in claim 2, wherein the plunger is fitted with at least one compressed flushing air outlet aperture disposed opposite the at least one powder feed aperture, and the plunger is configured to point the at least one compressed flushing air outlet into the at least one powder feed aperture only when said plunger enters the powder chamber to a predetermined depth of penetration.

10. The powder supply system as claimed in claim 9, wherein several powder feed apertures are arrayed mutually apart and in a first row and several compressed flushing air outlet apertures are arrayed in a second row and at the same mutual distance apart as the powder feed apertures, said first and second rows running parallel to each other and parallel to the guided path of the plunger.

11. The powder supply system as claimed in claim 1, wherein the plunger constitutes a chamber end face at one of the chamber ends.

12. The powder supply system as claimed in claim 1, further comprising a compressed airjet pump disposed in the residual powder outlet, or in a residual powder outlet duct, configured to induce a partial vacuum in the residual powder outlet through which compressed cleaning air and residual powder contained in the powder chamber are aspirated out of the powder chamber into the residual powder outlet.

13. The powder supply system as claimed in claim 1, further comprising a compressed conveying air intake configured to introduce compressed air into the residual powder outlet or a residual powder outlet duct.

14. The powder supply system as claimed in claim 1, wherein a chamber end-face wall configured opposite the front end face of the plunger is fitted with a plurality of feed apertures configured to introduce compressed air into the powder chamber.

15. The powder supply system as claimed in claim 1, further comprising a second plunger configured to be opposite the first plunger and reciprocable from the opposite chamber end into the powder chamber.

16. The powder supply system as claimed in claim 9, wherein each of the at least one powder feed aperture is fitted with the compressed cleaning air outlet aperture, and each powder feed aperture is associated with a given aperture of the compressed flushing air outlet apertures.

17. The powder supply system as claimed in claim 6, wherein one of the at least one compressed cleaning air outlet is configured perpendicular to the guided path.

18. The powder supply system as claimed in claim 1, wherein at least two chamber walls define the guided path extending from one chamber end to the opposite chamber end.

19. The powder supply system as claimed in claim 1, wherein the at least one powder feed aperture is configured to connect to a plurality of compressed air valves.

20. The powder supply system as claimed in claim 1, wherein the cross-section of the plunger has a shaped selected from the group consisting of rectangular, circular, polygonal and oval.

21. The powder supply system as claimed in claim 1, wherein the at least one compressed cleaning air outlet is configured to be outside the powder chamber when the plunger is at the opposite chamber end.

22. The powder supply system as claimed in claim 1, wherein the plunger is disposed in a manner that an outer periphery of the plunger is matched to an inner periphery of the powder chamber in a manner that a peripheral gap remains in-between, and the at least one compressed cleaning air outlet is configured to issue compressed air into said peripheral gap.

* * * * *